US008187394B2

(12) United States Patent
Ye et al.

(10) Patent No.: US 8,187,394 B2
(45) Date of Patent: May 29, 2012

(54) SOFT MAGNETIC POWDER

(75) Inventors: Zhou Ye, Lerberget (SE); Björn Skårman, Höganäs (SE)

(73) Assignee: Hoganas AB, Hoganas (SE)

( * ) Notice: Subject to any disclaimer, the term of this patent is extended or adjusted under 35 U.S.C. 154(b) by 301 days.

(21) Appl. No.: 12/516,053

(22) PCT Filed: Dec. 6, 2007

(86) PCT No.: PCT/SE2007/050945

§ 371 (c)(1),
(2), (4) Date: May 22, 2009

(87) PCT Pub. No.: WO2008/069749

PCT Pub. Date: Jun. 12, 2008

(65) Prior Publication Data

US 2010/0038580 A1 Feb. 18, 2010

(30) Foreign Application Priority Data

Dec. 7, 2006 (SE) ..... 0602652

(51) Int. Cl.
*H01F 1/147* (2006.01)

(52) U.S. Cl. ..... 148/306; 148/104; 428/403

(58) Field of Classification Search ..... None
See application file for complete search history.

(56) References Cited

U.S. PATENT DOCUMENTS

| | | | |
|---|---|---|---|
| 5,063,011 | A | 11/1991 | Rutz et al. |
| 5,595,609 | A | 1/1997 | Gay |
| 6,119,447 | A | 9/2000 | Eriksson et al. |
| 6,309,748 | B1 | 10/2001 | Lashmore et al. |
| 6,348,265 | B1 | 2/2002 | Jansson et al. |
| 6,372,348 | B1 | 4/2002 | Hanejko et al. |
| 6,562,458 | B2 | 5/2003 | Elgelid et al. |
| 2004/0061582 | A1 | 4/2004 | Kondo et al. |

FOREIGN PATENT DOCUMENTS

| | | | |
|---|---|---|---|
| DE | 3439397 | A1 | 4/1986 |
| EP | 1353341 | A1 | 10/2003 |
| JP | 11-251131 | A | 9/1999 |
| RU | 2040810 | | 7/1995 |
| WO | WO 97/30810 | A1 | 8/1997 |
| WO | WO 99/30901 | | 6/1999 |
| WO | WO 2005/023464 | | 3/2005 |

OTHER PUBLICATIONS

Decision to Grant issued in Russian counterpart No. 2009125920, dated Jan. 25, 2011.

International Search Report (PCT/ISA/210) for PCT/SE2007/050945 completed Mar. 5, 2008.

Written Opinion (PCT/ISA/237) for PCT/SE2007/050945 completed Mar. 10, 2008.

*Extended European Search Report issued in European counterpart No. 007852217.4, dated Aug. 8, 2011.

*Primary Examiner* — John Sheehan

(74) *Attorney, Agent, or Firm* — Buchanan Ingersoll & Rooney

(57) ABSTRACT

A powder magnetic core is provided for operating at high frequencies that is obtained by pressure forming an iron-based magnetic powder covered with an insulation film, which has a specific resistance more than 1000, preferably more than 2000, and most preferably more than 3000 μΩm, and a saturation magnetic flux density B above 1.5, preferably above 1.7, and most preferably above 1.9 (T). A method for the preparation of such cores as well as a powder which is suitable for the preparation also are provided.

19 Claims, No Drawings

SOFT MAGNETIC POWDER

FIELD OF THE INVENTION

The present invention concerns a powder for the preparation of soft magnetic materials as well as the soft magnetic materials which are obtained by using this powder. Specifically the invention concerns powders for the preparation of soft magnetic composite materials working at high frequencies.

BACKGROUND OF THE INVENTION

Soft magnetic materials are used for applications, such as core materials in inductors, stators and rotors for electrical machines, actuators, sensors and transformer cores. Traditionally, soft magnetic cores, such as rotors and stators in electric machines, are made of stacked steel laminates. Soft Magnetic Composite, SMC, materials are based on soft magnetic particles, usually iron-based, with an electrically insulating coating on each particle. By compacting the insulated particles optionally together with lubricants and/or binders using the traditionally powder metallurgy process, the SMC parts are obtained. By using this powder metallurgical technique it is possible to produce SMC components with a higher degree of freedom in the design, than by using the steel laminates as the SMC material can carry a three dimensional magnetic flux and as three dimensional shapes can be obtained by the compaction process. In order to make the SMC parts high-performance and downsize them, it is indispensable to improve the performance of soft magnetic powders.

One important parameter in order to improve the performance of SMC parts is to reduce its core loss characteristics. When a magnetic material is exposed to a varying field, energy losses occur due to both hysteresis losses and eddy current losses. The hysteresis loss is proportional to the frequency of the alternating magnetic fields, whereas the eddy current loss is proportional to the square of the frequency. Thus at high frequencies the eddy current loss matters mostly and it is especially required to reduce the eddy current loss and still maintaining a low level of hysteresis losses. This implies that it is desired to increase the resistivity of magnetic cores.

In the search for ways of improving the resistivity different methods have been used and proposed. One method is based on providing electrically insulating coatings or films on the powder particles before these particles are subjected to compaction. Thus there is a large number of patent publications which teach different types of electrically insulating coatings. Examples of recently published patents concerning inorganic coatings are the U.S. Pat. No. 6,309,748, U.S. Pat. No. 6,348,265 and U.S. Pat. No. 6,562,458. Coatings of organic materials are known from e.g. the U.S. Pat. No. 5,595,609. Coatings comprising both inorganic and organic material are known from e.g. the U.S. Pat. Nos. 6,372,348 and 5,063,011 and the DE patent publication 3,439,397, according to which publication the particles are surrounded by an iron phosphate layer and a thermoplastic material.

In order to obtain high performance SMC parts it must also be possible to subject the electrically insulated powder to compression moulding at high pressures as it is often desired to get parts having high density High densities normally improve the magnetic properties. Specifically high densities are needed in order to keep the hysteresis losses at a low level and to obtain high saturation flux density. Additionally the electrical insulation must withstand the high compaction pressures needed without being damaged when the compacted part is ejected from the die. This in turn means that the ejection forces must not be too high.

Furthermore, in order to further reduce the hysteresis losses, stress release heat treatment of the compacted part is required. In order to obtain an effective stress release the heat treatment should preferably be performed at a temperature above 300° C. and below a temperature, where the insulating coating will be damaged, about 600° C., in a non-reducing atmosphere.

The present invention has been done in view of the need for powder cores which are primarily intended for use at higher frequencies, i.e. frequencies above 2 kHz and particularly between 5 and 100 kHz, where higher resistivity and lower core losses are essential. The core material should also have a high saturation flux density for core downsizing. Additionally it should be possible to produce the cores without the need of compacting the metal powder using die wall lubrication and/or elevated temperatures. Preferably these steps should be eliminated.

In contrast to many used and proposed methods, in which low core losses are desired, it is an especial advantage of the present invention that it is not necessary to use any organic binding agent in the powder composition, which is used in the compaction step. The heat treatment of the green compact can therefore be performed at higher temperature without the risk that the organic binding agent decomposes. A higher heat treatment temperature will also improve the flux density and decrease core losses. The absence of organic material in the final, heat treated core also allows that the core can be used in environments having elevated temperatures without risking decreased strength due to softening and decomposition of an organic binder and improved temperature stability is achieved.

Powder Magnetic Core

The powder magnetic core of the present invention is obtained by pressure forming an iron-based magnetic powder covered with a new electrically insulating coating. The core may be characterized by low total losses in the frequency range 2-100, preferably 5-100, kHz and a resistivity, ρ, more than 1000, preferably more than 2000 and most preferably more than 3000 μΩm, and a saturation magnetic flux density Bs above 1.5, preferably above 1.7 and most preferably above 1.9 (T).

The Iron Base Powder

In accordance with the present invention the term "iron base powder" is intended to include an iron powder composed of pure iron and having an iron content of 99.0% or more. Examples of powders with such iron contents are ABC100.30 or ASC300, available from Höganäs A B, Sweden. Water atomised powders having irregularly shaped particles are especially preferred.

Furthermore the iron base powder particles should have a particle size less 100 μm. Preferably the particle sizes should be less than 75 μm (200 mesh). More preferably the powders used for preparation of the magnetic cores according to the present invention should have a particle size such that $D_{90}$ should be 75 μm or less and $D_{50}$ should be between 50 μm and 10 μm. ($D_{90}$ and $D_{50}$ mean that 90 percent by weight and 50% by weight, respectively, has a particle size below the values of $D_{90}$ and $D_{50}$, respectively.

Insulation Coating

The insulating coating on the surfaces of the respective particles of the iron-base magnetic powder is essential in order to obtain the powder magnetic core exhibiting a the larger specific resistance and the low core losses.

As previously mentioned there are several publications disclosing different types of insulating coatings or films on powder particles. In practice films or coatings based on the use of a phosphoric acid have turned out to be successful. The methods of preparing these coatings include e.g. mixing phosphoric acids in water or organic solvents with the iron-based magnetic powders. Thus the magnetic powders may e.g. be immersed into the phosphoric acid solutions. Alternatively, the solutions are sprayed on the powders. Examples of organic solvents are ethanol, methanol, isopropyl alcohol, acetone, glycerol etc. Suitable methods for the preparation of films or coatings on iron powders are disclosed in the U.S. Pat. Nos. 6,372,348 and 6,348,265. The insulating material can be applied by any method that results in the formation of a substantially uniform and continuous insulating layer surrounding each of the iron base particles. Thus mixers that are preferably equipped with a nozzle for spraying the insulating material onto the iron base particles can be used. Mixers that can be used include for example helical blade mixers, plow blade mixers, continuous screw mixers, cone and screw mixers, or ribbon blender mixers.

When this method is applied for providing thicker coatings e.g. by using high concentrations of phosphoric acid, the insulating properties may be improved, i.e. the resistivity may be increased to a certain extent.

In order to obtain higher resistivity it has been found that this may be achieved by repeating the treatment of the iron base powder with the phosphoric solution. This treatment may be performed with the same or different concentrations of phosphoric acid in water or an organic solvent of the type mentioned above.

The amount of phosphoric acid dissolved in the solvent, should correspond to the desired coating thickness on the coated powder particles as defined below. It has been found that a suitable concentration of phosphoric acid in acetone is between 5 ml to 100 ml phosphoric acid per litre of acetone and the total added amount of acetone solution to 1000 gram of powder is suitable 5 to 300 ml. It is not necessary or even preferred to include elements such as Cr, Mg, B or other substances or elements which have been proposed in the coating liquids intended for electrical insulation of soft magnetic particles. Accordingly it is presently preferred to use only phosphoric acid in a solvent in such concentrations and treatment times so as to obtain the indicated relationship between the particle size, oxygen and phosphorus content. The powder may be completely or partially dried between the treatments.

Furthermore, and in the context of the present application, it should be noted that the insulating coating is very thin and in practice negligible in relation to the particle size of the iron base powder. The particle size of the insulated powder particles is thus practically the same as that of the base powder.

The Electrically Insulated Iron Powder

The phosphate coated iron base powder particles according to the invention can be further characterised as follows. The coated particles comprise iron base powder particles having an oxygen content less than 0.1% by weight. Furthermore, the powder of electrically insulated particles has an oxygen content at most 0.8% by weight and a phosphorus content of at least 0.04% by weight higher than that of the base powder. Additionally the quotient of the total oxygen content of the insulated powder and the difference between the phosphorus content of the powder with insulated particles and that of the base powder, $O_{tot}/\Delta P$, is between 2 and 6.

Specifically, the relation between oxygen content, the difference between the phosphorous content of the base powder and the phosphorous content of the insulated powder, $\Delta P$, and mean particle size, $D_{50}$, expressed as $\Delta P/(O_{tot}*D_{50})$ is between 4.5 and 50 1/mm.

A value below 4.5 in the above mentioned relation, will give higher core loss due to higher eddy currents created within the individual iron-based particles or within the total component. A value above 50 will give unacceptably low saturation magnetic flux density.

Mixing Step

The powder with thus insulated particles is subsequently mixed with a lubricant, such as a metal soap e.g. zinc stearate, a wax such as EBS or polyethylene wax, primary or secondary amides of fatty acids or other derivates of fatty acids, amide polymers or amide oligomers, Kenolube® etc. Normally the amount of lubricant is less than 1.0% by weight of the powder. Examples of ranges of the lubricant are 0.1-0.6, more preferably 0.2-0.5% by weight.

Although the present invention is of particular interest for compaction with internal lubrication, i.e. wherein the lubricant is admixed with the powder before the compaction step, it has been found that for certain applications where high density is of special importance the insulated powders may be compacted with only external lubrication or a combination of internal and external lubrication (die wall lubrication).

As previously mentioned it is a special advantage that it is not necessary to use any binder in order to obtain the high resistivity and the low total core losses. The use of binders in the compositions to be compacted is however not excluded and if present binders, such as PPS, amidoligomers, polyamides, polyimides, polyeterimids could be used in amounts between 0.05%-0.6%. Other inorganic binders such as water glass may also be of interest.

Compacting Step

The powders according to the invention are subsequently subjected to uniaxially compaction in a die at pressures which may vary between 400 and 1500 MPa, more particularly between 600 and 1200 MPa. The compaction is preferably performed at ambient temperature but the compaction may also be performed with heated dies and/or powders.

Heat Treatment

The heat treatment is performed in a non reducing atmosphere, such as air, in order not to negatively influence the insulated coating. A heat treatment temperature below 300° C. will only have a minor stress releasing effect and a temperature above 600° C. will deteriorate the phosphorous containing coating. The period for heat treatment normally varies between 5 and 500 minutes, more particularly between 10 and 180 min.

The powder magnetic core obtained by using the inventive powder can be used for a variety of electromagnetic equipment, such as motors, actuators, transformers, induction heaters (IH) and speakers. However, the powder magnetic core is especially suited for inductive elements used in inverters or in converters working at frequencies between 2 and 100 kHz. The obtained combination of high magnetic flux saturation and low hysteresis and eddy current losses which give low total core losses permits downsizing of the components, higher energy efficiency and higher working temperatures.

EXAMPLES

The following example is intended to illustrate particular embodiments and not to limit the scope of the invention.

The particle size distribution of different water atomised, pure iron base powders were measured with the aid of a laser diffraction device, Sympathec.

Example 1

A coating solution was prepared by dissolving 30 ml of 85% weight of phosphoric acid in 1 000 ml of acetone.

The samples a-d), which are comparative examples, were treated with a solution of phosphoric acid in acetone as described in U.S. Pat. No. 6,348,265 whereas sample e-g), according to the invention, were treated according to below;

Sample e) was treated with totally 50 ml of acetone solution per 1000 grams of powder.

Sample f) was treated with totally 40 ml of acetone solution per 1000 gram of powder.

Sample g) was treated with totally 60 ml of acetone solution per 1000 gram of powder.

Example 2

Further Treatment

The powders were further mixed with 0.5% of a lubricant, KENOLUBE® and moulded at ambient temperature into rings with an inner diameter of 45 mm, an outer diameter of 55 mm and a height of 5 mm at a pressure of 800 MPa. A heat treatment process at 500° C. for 0.5 h in an atmosphere of air was performed.

The specific resistivity of the obtained samples were measured by a four point measurement according to reference Koefoed O., 1979, Geosounding Principles 1: Resistivity sounding measurements. Elsevier Science Publishing Company, Amsterdam.

For core loss and magnetic saturation flux density measurements the rings were "wired" with 112 turns for the primary circuit and 25 turns for the secondary circuit enabling measurements of magnetic properties measured at 0.1 T, 10 kHz and 0.2 T, 10 kHz, respectively, with the aid of a hysteresis graph, Brockhaus MPG 100

Table 1 shows the particle size distribution, the content of oxygen and phosphorous in base powder as well as in the coated powder, the relation between $O_{tot}$, ΔP and $D_{50}$.

Table 2 shows the specific resistivity, the core loss and saturation flux density of the obtained heat treated parts. Furthermore, table 2 shows that a combination of high specific resistivity, low core losses and high magnetic flux density low core losses is obtained for components produced with powder according to the invention.

TABLE 1

| Sample | base powder | D50/D90 | P in base powder | O in base powder | $P_{tot}$ (%) | $O_{tot}$ (%) | $O_{tot}/\Delta P$ | $\Delta P/(O_{tot} * D50)$ |
|---|---|---|---|---|---|---|---|---|
| a | ABC100.30 | 95/150 | 0.005 | 0.03 | 0.055 | 0.17 | 3.4 | 3.1 |
| b | ABC100.30 | 95/150 | 0.005 | 0.03 | 0.016 | 0.08 | 7.3 | 1.4 |
| c | ASC300 | 35/45 | 0.005 | 0.05 | 0.047 | 0.34 | 8.2 | 3.5 |
| d | high purity iron powder | 200/300 | 0.005 | 0.03 | 0.029 | 0.09 | 3.7 | 1.4 |
| e | high purity iron powder | 40/63 | 0.005 | 0.05 | 0.075 | 0.3 | 4.3 | 5.8 |
| f | high purity iron powder | 40/63 | 0.005 | 0.05 | 0.06 | 0.2 | 3.6 | 6.9 |
| g | high purity iron powder | 40/63 | 0.005 | 0.05 | 0.09 | 0.3 | 3.5 | 7.1 |

TABLE 2

| Sample | base powder | Density (g/ml) | Resistivity (μohm · m) | Core Loss (W/kg) @0.2T 10 kHz | Core Loss (W/kg) @0.1T 10 kHz | Bs (T) |
|---|---|---|---|---|---|---|
| a | ABC100.30 | 7.33 | 3000 | 130 | 33 | 2 |
| b | ABC100.30 | 7.38 | 50 | | 80 | |
| c | ASC300 | 7.02 | 5000 | 170 | 43 | 1.85 |
| d | high purity iron powder | 7.45 | 500 | 210 | 55 | 2.03 |
| e | high purity iron powder | 7.30 | 5000 | 90 | 25 | 2 |
| f | high purity iron powder | 7.33 | 5000 | 88 | 24 | 2.01 |
| g | high purity iron powder | 7.28 | 9000 | 89 | 24 | 2 |

The invention claimed is:

1. An iron powder consisting of electrically insulated, iron base powder particles, which have a particle size less than 100 μm, wherein the iron base powder has an oxygen content less than 0.1% by weight, the electrically insulated, iron base powder particles has a total oxygen content, $O_{tot}$, at most 0.8% and a total phosphorus content at least 0.04% by weight higher than those of the iron base powder particles such that the quotient of the total oxygen content of the electrically insulated, iron base powder particles and the difference between the total phosphorus content of the electrically insulated, iron base powder particles and the iron base powder particles, ΔP, is between 2 and 6 and where the relation between the total oxygen content of the electrically insulated, iron base powder particles, and the difference between the total phosphorous content of the electrically insulated, iron base powder particles and the phosphorous content of the iron base powder particles, ΔP, and mean particle size, $D_{50}$, expressed as $\Delta P/(O_{tot}*D_{50})$ is between 4.5 and 50 1/mm.

2. Iron powder according to claim 1, wherein $D_{90}$ is below 75 μm and $D_{50}$ is between 10 μm and 50 μm.

3. Iron powder according to claim 1, wherein $P_{tot}$ is equal to, or higher than 0.05%.

4. A powder magnetic core for operating at frequencies between 2 and 100 kHz obtained by compaction moulding of an iron powder, the particles of which are less than 100 μm and which particles are provided with electrically insulating inorganic coating, wherein the iron base powder has an oxygen content less than 0.1% by weight, the electrically insulated, iron base powder particles has a total oxygen content, $O_{tot}$, at most 0.8% and a total phosphorus content at least 0.04% by weight higher than those of the iron base powder particles such that the quotient of the total oxygen content of the electrically insulated, iron base powder particles and the difference between the total phosphorus content of the electrically insulated, iron base powder particles and the iron base powder particles, ΔP, is between 2 and 6 and where the relation between the total oxygen content of the electrically insulated, iron base powder particles, and the difference between the total phosphorous content of the electrically insulated, iron base powder particles and the phosphorous content of the iron base powder particles, ΔP, and mean particle size, $D_{50}$, expressed as $\Delta P/(O_{tot}*D_{50})$ is between 4.5 and 50 1/mm, and said core having:

a specific resistance ρ above 1000 μΩm, and a saturation magnetic flux density B above 1.5 (T).

5. A powder magnetic core according to claim 4, wherein the electrically insulated particles have a $D_{90}$ of 75 μm or less and a $D_{50}$ between 10 μm and 50 μm.

6. A powder magnetic core according to claim 4, wherein the electrically insulating coating comprises phosphorus.

7. A powder magnetic core according to claim 4 having a core loss of at most 30 W/kg at 0.1 T and 10 kHz.

8. Method of preparing an iron core comprising the steps of mixing an insulated powder as defined in claim 1 with a lubricant in an amount less than 1% of weight;

filling the obtained mixture into a die, compacting said mixture, ejecting the obtained body from the die, and heating the green body.

9. Method according to claim 8, wherein the compaction is performed at ambient temperature.

10. A method of producing the iron powder according to claim 1 comprising the steps of:

a) treating an iron base powder at least once with phosphoric acid dissolved in a solvent; and b) drying the obtained, coated powder.

11. Iron powder according to claim 2, wherein $P_{tot}$ is equal to, or higher than 0.05%.

12. A powder magnetic core according to claim 4 for operating at frequencies of between 5 and 100 kHz having a specific resistance ρ above 2000 μΩm, and a saturation magnetic flux density B above 1.7 (T).

13. A powder magnetic core according to claim 4 for operating at frequencies between 5 and 100 kHz having a specific resistance ρ above 3000 μΩm, and a saturation magnetic flux density above 1.9 (T).

14. A powder magnetic core according to claim 5 wherein the electrically insulating coating comprises phosphorus.

15. A powder magnetic core according to claim 5 having a core loss of at most 30 W/kg at 0.1 T and 10 kHz.

16. A powder magnetic core according to claim 6 having a core loss of at most 30 W/kg at 0.1 T and 10 kHz.

17. Method of preparing an iron core comprising the steps of mixing an insulated powder as defined in claim 2 with a lubricant in an amount less than 1% of weight;

filling the obtained mixture into a die, compacting said mixture, ejecting the obtained body from the die, and heating the green body.

18. Method of preparing an iron core comprising the steps of mixing an insulated powder as defined in claim 3 with a lubricant in an amount less than 1% of weight;

filling the obtained mixture into a die, compacting said mixture, ejecting the obtained body from the die, and heating the green body.

19. Method of preparing an iron core comprising the steps of mixing an insulated powder as defined in claim 11 with a lubricant in an amount less than 1% of weight;

filling the obtained mixture into a die, compacting said mixture, ejecting the obtained body from the die, and heating the green body.

* * * * *